US006746269B1

(12) United States Patent
Casses

(10) Patent No.: US 6,746,269 B1
(45) Date of Patent: Jun. 8, 2004

(54) CONNECTION DEVICES FOR A FLEXIBLE CIRCUIT

(75) Inventor: Claude Casses, Clevilliers (FR)

(73) Assignee: FCI, Paris (FR)

( * ) Notice: Subject to any disclaimer, the term of this patent is extended or adjusted under 35 U.S.C. 154(b) by 0 days.

(21) Appl. No.: 10/111,021

(22) PCT Filed: Oct. 26, 2000

(86) PCT No.: PCT/EP00/10561

§ 371 (c)(1),
(2), (4) Date: Jul. 22, 2002

(87) PCT Pub. No.: WO01/31748

PCT Pub. Date: May 3, 2001

(30) Foreign Application Priority Data

Oct. 28, 1999 (FR) ..... 99 13772

(51) Int. Cl.[7] ..... H01R 4/22
(52) U.S. Cl. ..... 439/422
(58) Field of Search ..... 439/409, 422, 439/465, 467, 499

(56) References Cited

U.S. PATENT DOCUMENTS 3,697,925 A 10/1972 Henschen ..... 339/17 F
4,082,402 A 4/1978 Kinkaid et al. ..... 339/97 C
4,382,652 A 5/1983 Sinclair ..... 339/103 M
4,784,623 A 11/1988 Beck, Jr. ..... 439/872
5,860,832 A * 1/1999 Wayt et al. ..... 439/465
5,941,728 A * 8/1999 Okabe et al. ..... 439/467
6,383,015 B2 * 5/2002 Mochizuki et al. ..... 439/492
6,443,758 B2 * 9/2002 Nagai ..... 439/465

FOREIGN PATENT DOCUMENTS

EP 0945920 A1 9/1999

* cited by examiner

*Primary Examiner*—Renee Luebke
*Assistant Examiner*—Ann McCamey
(74) *Attorney, Agent, or Firm*—Perman & Green, LLP

(57) ABSTRACT

A connection device is provided for connecting a flexible circuit. Said connection device having a casing in which is constructed at its front end a series of plug sockets for receiving connectors. The connectors include electrical contact terminals for crimping to a flexible circuit. A cover is attached to the casing that pivots from an open position, in which the connectors may be inserted in the plug sockets, and a close position in which the connectors are locked in place. Upper and lower openings are constructed in the casing to allow the crimping of the terminals after they are locked in place.

12 Claims, 7 Drawing Sheets

CONNECTION DEVICES FOR A FLEXIBLE CIRCUIT

This application claims the benefit of the earlier filed International Application No. PCT/EP00/10561, International Filing Date, Oct. 26, 2000, which designated the United States of America, and which international application was published on May 3, 2001, as International Publication No. WO/31748 A1.

BACKGROUND OF THE INVENTION

The present invention relates to a connection device for a flexible circuit and more particularly a connector module for a flexible circuit as well as the connection procedure for the same.

Flexible circuits generally consist of a first sheet of flexible insulating material on which are arranged conducting tracks, for example, of copper, these tracks being themselves covered by either a second sheet of insulating material or by an insulating varnish. There circuits are widely used in the electrical industry and several methods of connection exist for connecting them to electrical connectors or to electronic components.

U.S. Pat. No. 4,082,402 relates to the implementation of a connector for a flexible circuit whose electrical contacts comprise, on the one hand, flexible circuit piercing wings and on the other hand a connector termination with a supplementary connector. These connectors, which are connected to the flexible circuit by means of crimping, are contained in a supplementary insulating housing in which the connection is assembled for crimping.

The connection of flexible circuits by crimping using multiple connectors requires close attention to the crimped connection of the flexible circuit and the connectors, as well as to the connector lead. It is, in particular, necessary to protect the interface of the flexible circuit and the connector against a possible detachment.

It is moreover desirable to be able to make connections of the flexible circuit with the connectors in a pre-fitted position. To this end, U.S. Pat. No. 4,082,402 provides a casing comprising plug sockets for the reception of connectors, the rear portion of these sockets including a supporting plate that allows crimping of the flexible circuit to the connectors. The rear portion of the casing, which receives the flexible circuit, is then closed by a hinged flap. This flap protects the connector terminations and the flexible circuit itself.

BRIEF SUMMARY OF THE INVENTION

The present invention proposes to improve the connector of the prior art and its connection procedure and in particular, to facilitate its manipulation and to make the crimping operation more reliable.

To this end, the invention concerns, in particular, a flexible circuit connection device comprising a casing having at least one row of longitudinal plug sockets for the reception of connectors. The connectors include crimping and electrical contact terminations for the flexible circuit. A cover component is attached to the casing for manipulation between a position in which the connectors can be pre-inserted and a position in which the said connectors are locked in place. The cover component consisting of a frame provided with an opening for admitting a component of the crimping tool.

In a preferred embodiment of the invention, the casing comprises a window between the front portion having the plug sockets and a rear portion having connector guide grooves. The window provides an opening for admitting a counter thrust tool.

The frame and the casing can advantageously be fitted with supplementary latching components.

The frame includes, on its rear portion, an opening for inserting the flexible circuit, after the cover has been closed. Alternately, the frame can be raised in relation to the flexible circuit connection terminations.

According to the invention, the cover can be equipped, still at its rear end, with at least one lug designed to be inserted in a hole made in the flexible circuit, the casing being equipped with a seat for receiving and retaining the lug.

In a preferred embodiment of the invention, the lug can be arranged on a foldable blade terminal which forms part of the frame.

Still according to the invention, the casing can constitute a connection module designed to be arranged in a module carrier connector component. In that case, supplementary latching devices can, in particular be provided in a first position called the loading of module or in a position of pre-insertion of the modules and a second position called connection position.

According to the invention, the procedure of connection of the flexible circuit comprises the following sequence of steps, namely, the insertion of the connectors into the plug sockets of the casing, the closure of the cover component onto the connectors, the sliding of the flexible circuit into a space between the cover and the crimping of the connectors to the flexible circuit, the crimping of the flexible circuit to the connectors taking place by means of a tool inserted into the frame.

The flexible circuit is provided with at least one hole, and a step of centering and locking the flexible circuit into the casing is accomplished by the insertion of a lug that forms part of the frame. This serves to lock the flexible circuit into the said hole. This step occurs after the steps of inserting the flexible circuit and the stage of crimping.

For a connector component of the module carrier comprising one module, the steps can be implemented with the module pre-inserted into the module carrier.

For a connector component of the module carrier comprising several modules, the crimping operation is carried out on the modules outside the module carrier, the cabled modules with their flexible circuit being then inserted into the module carrier.

BRIEF DESCRIPTION OF THE DRAWINGS

The invention will be better understood by reading the description of a particular non-limiting embodiment of the invention, in conjunction with the drawings which show the following aspects of the invention.

DETAILED DESCRIPTION OF THE DISCLOSED EMBODIMENTS

Figure 1:
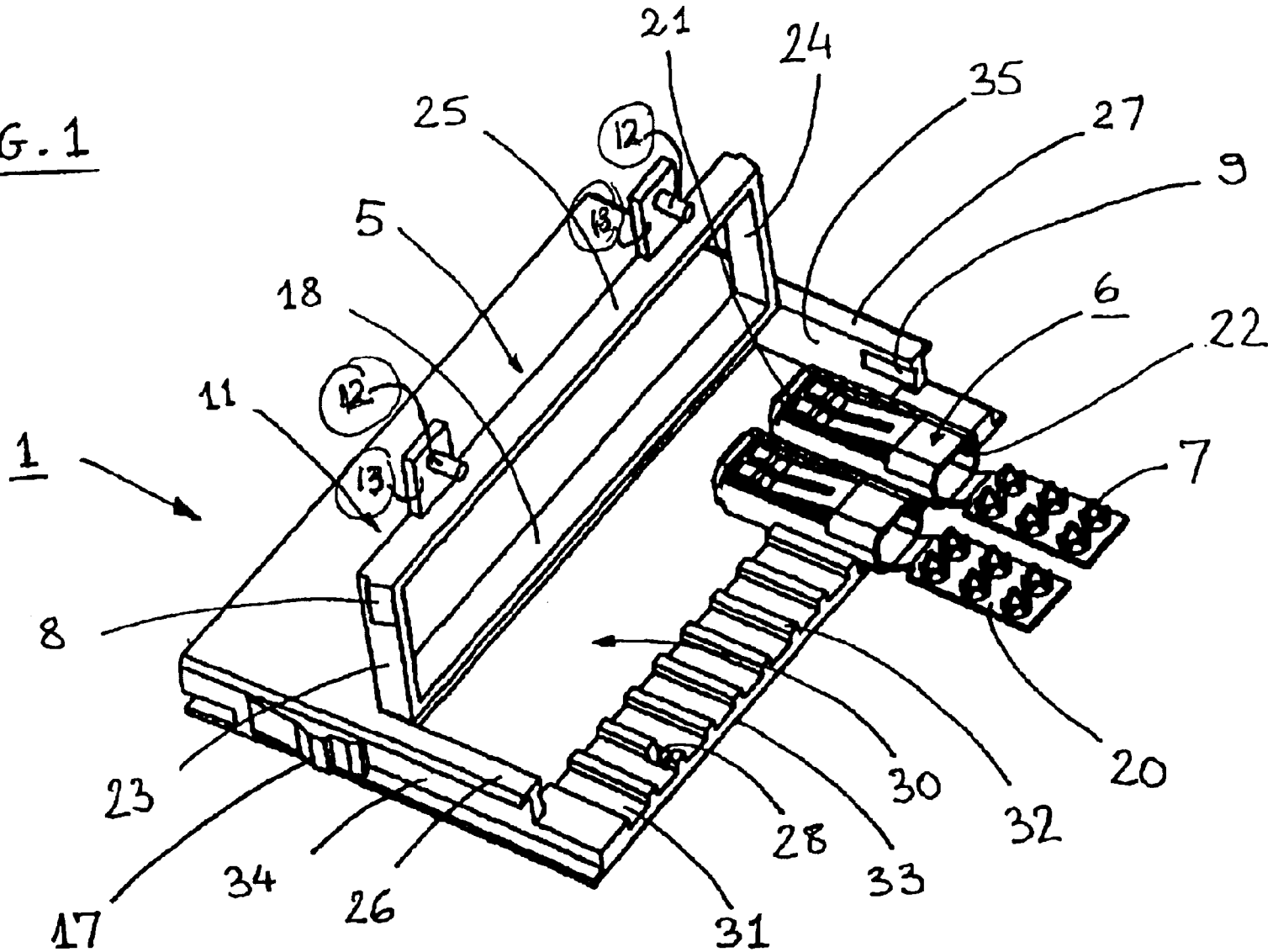
FIG. 1 shows a perspective side view of a device according to the invention with the connectors in the pre-insertion position.
Figure 3:
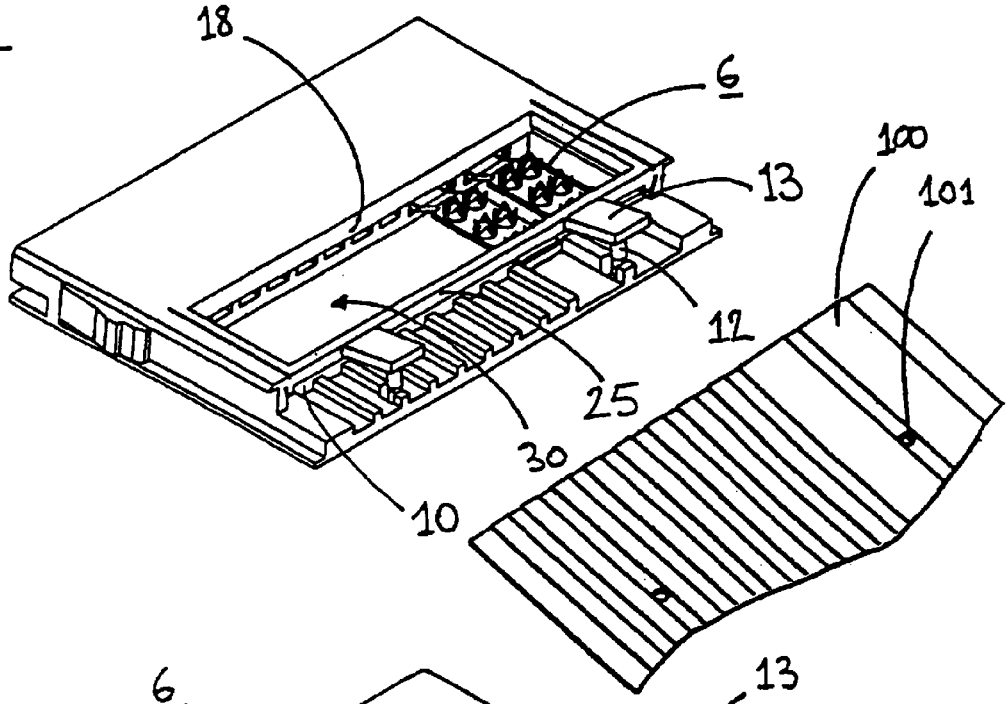
FIG. 3 shows a perspective side view of a device according to the invention with the connectors in the inserted position, with the retaining device closed, without the flexible circuit.
Figure 4:
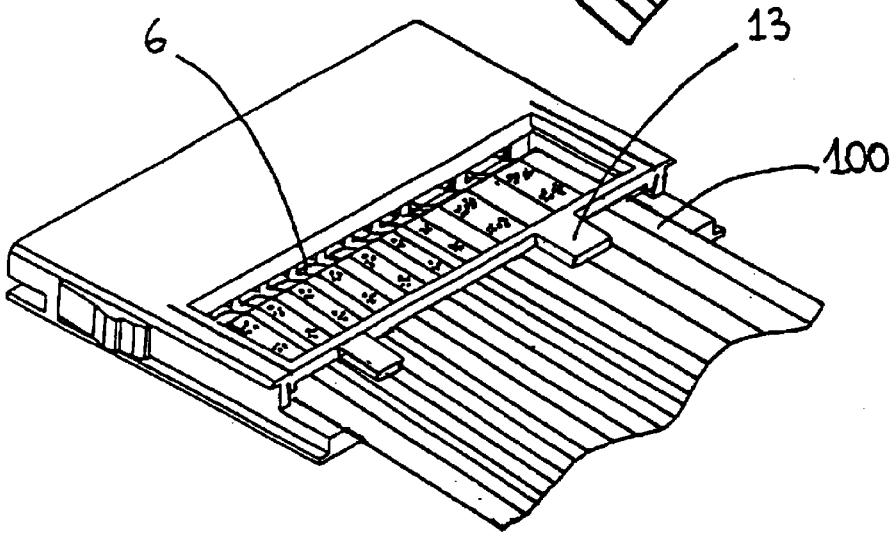
FIG. 4 shows a perspective side view of a device according to the invention with the connectors in the inserted position, the flexible circuit being crimped on the connectors and the cover in the locked position of the connectors and the position of retention of the flexible circuit.

FIG. 1 represents a connection device for flexible circuit 100, shown in FIG. 3. The device comprising a casing (1) fitted with at least one row of longitudinal plug sockets for receiving the connectors (6). The connectors 6, of which two are shown in FIG. 1, comprise terminations (7) for forming a crimped electrical connection to the flexible circuit. Crimping terminations 7 are formed from a flat portion 20 of connector 6. Connector 6 moreover comprising, in traditional fashion, a connector termination (21) for connection with a supplementary connector (not shown). Termination 21 is a female termination in the example shown, but which can be of any other known type.

The connector (6) are longitudinally inserted into the casing (1) and, during the are guided by the grooves (31) and the notches (32) made in the rear portion of the casing. These connectors can, for example, be provided in familiar fashion with means of locking them into the plug sockets of the casing (not shown).

The casing comprises a cover component (5), shown in FIG. 1 in an open position, which allows the insertion of the connectors 6. The cover 5 is maneuverable between a position for pre-insertion of the connectors 6 and a position for locking the connectors 6. This locked position is shown in FIG. 3 and shows that a wall (18) of the cover component blocks the connectors by resting against a ridge (22) of the connector termination with a supplementary connector. The cover 5 consists of a frame (11) provided with an opening to admit a component of a crimping tool (50). The frame 11 is constructed having side walls (23, 24), a rear wall (25) and a wall (18) which blocks the connector.

The frame 11 and the casing 5 are provided with supplementary latching components (8, 9). These components are positioned respectively, as is shown in the example of FIG. 1, on the side walls of the cover and on side walls (26, 27) of the casing. The latching of these catches into these reinforcements locks the connectors. The casing, with its connectors, can then be readily manipulated and can receive the flexible circuit without danger of connector misalignment.

As can be seen in FIG. 3, the frame includes an opening (10) on the wall 25 that provides a space for the introduction of the flexible circuit 100. Alternatively, the frame 11 can be slightly raised, in relation to the connector terminations 7, so that flexible circuit 100 can be introduced under the frame 11 via the rear of the casing 5. The side walls (23) and (24) guide the flexible circuit sideways and the flexible circuit is inserted above the crimping terminations until it stops against wall (18).

As can be seen, in particular, in FIG. 1, the cover 5 is provided at its rear end with at least one lug (12) designed to be inserted into a hole (101) of the flexible circuit 100. Two lugs are advantageously provided. The lugs 12 hold the flexible circuit 100 in place, after it has been inserted and positioned with respect to the crimping terminations in such a way as to allow accurate crimping to the conducting tracks of the flexible circuit.

Still for the purpose of improving the retention of the flexible circuit, the casing is fitted with a seat (28) for the reception and retention of this lug.

Figure 5A:
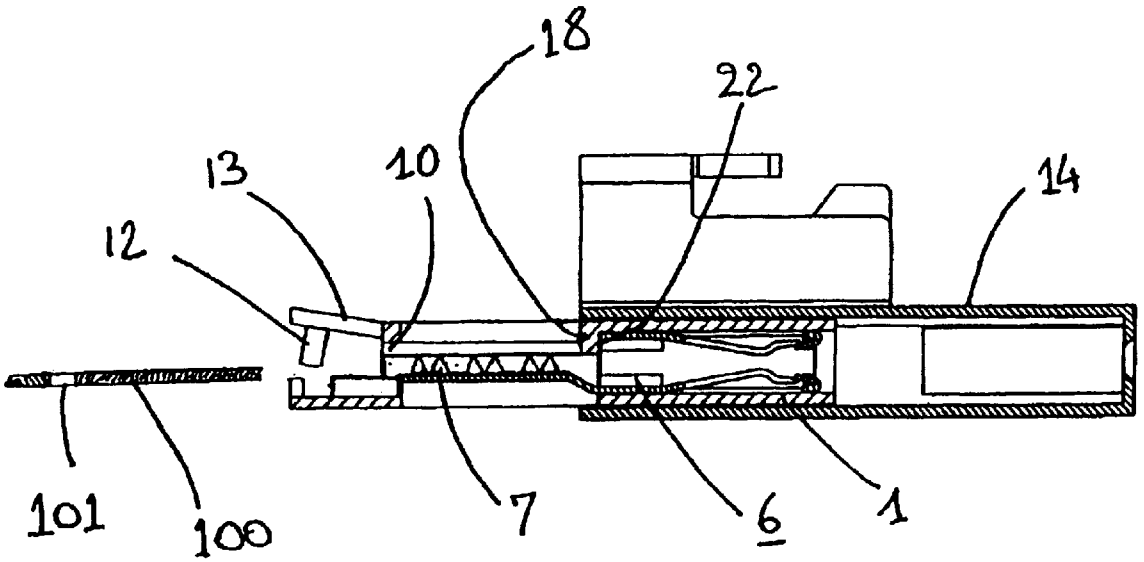
FIGS. 5*a* and 5*b* respectively show two section views of FIGS. 3 and 4 which show the introduction of the flexible circuit.

As can be seen in FIG. 1, the lug or lugs (12) is/are carried by a folding blade terminal (13) which forms part of the frame. It is possible to provide a single blade terminal, or one for each lug. In FIG. 5*a* the lug (12) is shown in the position which allows the flexible circuit to be inserted and in FIG. 5*b*, the lug 12 is shown in the position in which the flexible circuit 100 is held for crimping by a tool (50) as shown in FIG. 5*b*.

The crimping is performed by squeezing the teeth of the crimping terminations (7) which penetrate the flexible circuit and are folded on the flexible circuit by the action of the tool (50) and the counter-tool (51) which exercises counter thrust.

Figure 5B:
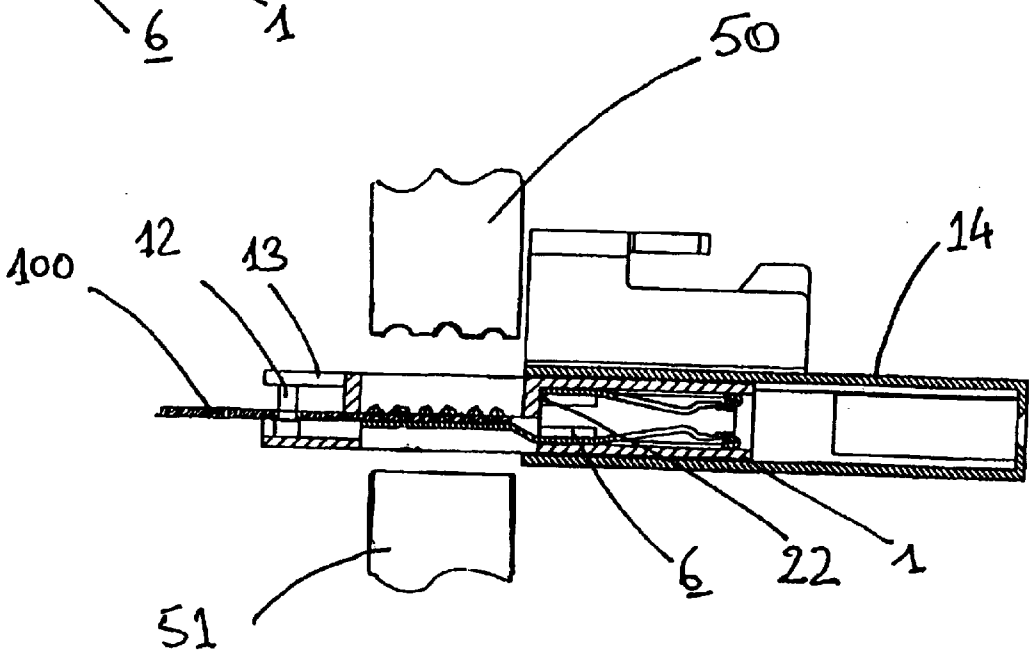

As can be seen, in particular, in FIGS. 1 and 5*b*, the casing 1 includes a window (30) arranged between a front portion of the said casing 1 and a rear portion (33) which forms a beam having connector guide grooves (31). The window 30 provides an opening to allow the entry of a counter thrust tool 51. The said counter thrust tool allows more accurate crimping than is the case in the prior art, where the connectors bear against a floor of the casing.

Figure 2A:
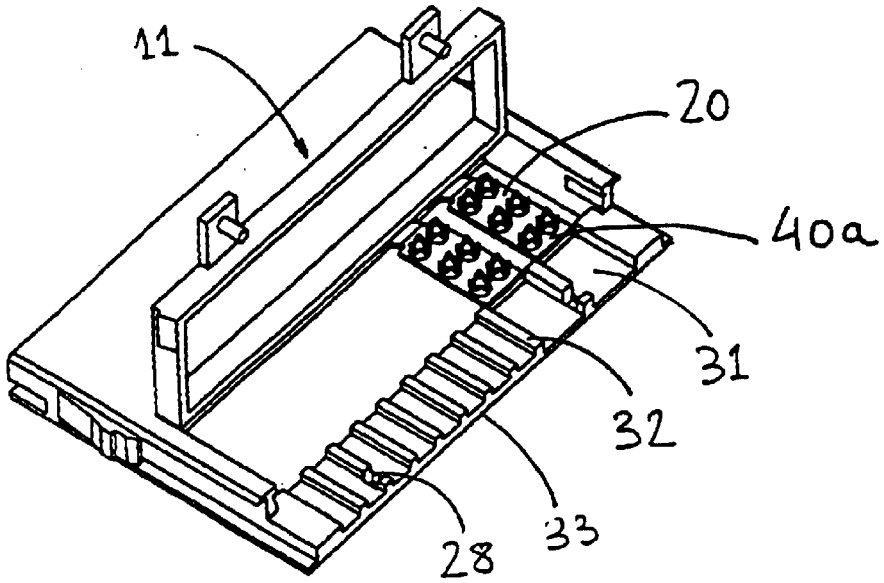
FIGS. 2*a* and 2*b* respectively show perspective side views of a device according to the invention with the connectors in the inserted position.
Figure 2B:
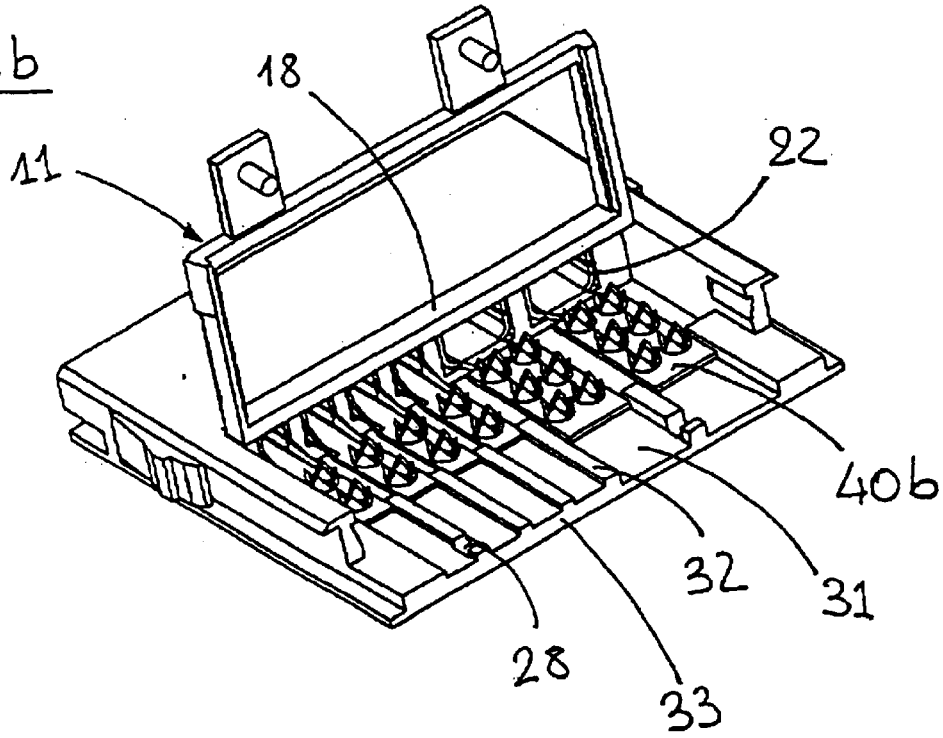

The portions of the connectors, which are provided with crimping terminations 7, can, when the connectors are fully inserted in the plug sockets, either become completely disengaged from the rear beam 33, as shown in FIG. 2*a* by connector (40*a*), or lengthened in order to preserve a side retention of the crimping terminations 7 between the notches (32), as can be seen in FIG. 2*b* connector (40*b*).

In this case it is nevertheless desirable that the rear portion of the connector should not rest on the bottom of groove (31) to avoid hindering the crimping action of the crimping tool (50) and the counter-tool (51)

The beam (33) is linked to the front of the casing by the arms (34) and (35) that frame the window 30, these arms including latching components (9) of the frame (5)

Figure 6A:
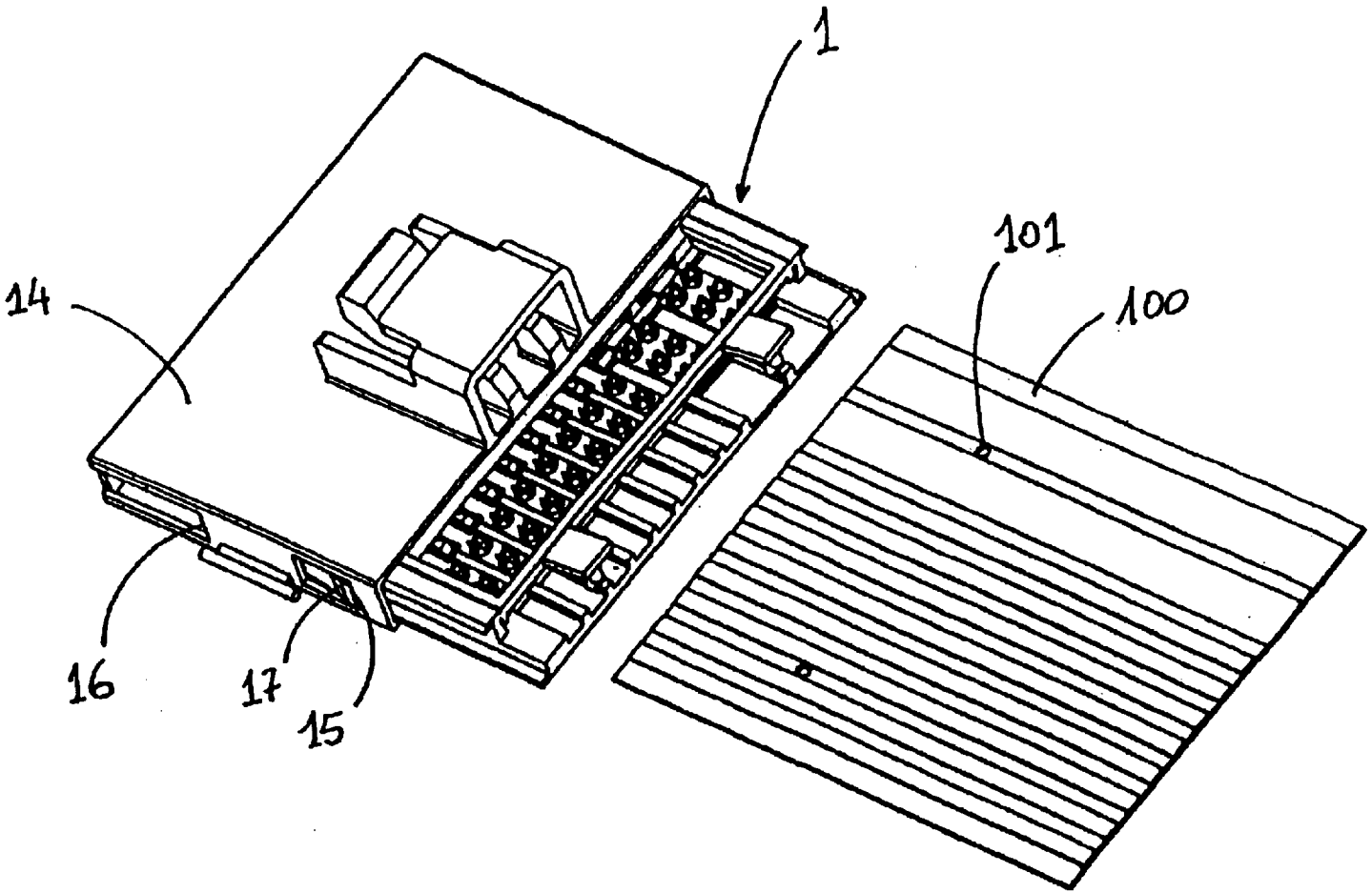
FIGS. 6*a* and 6*b* respectively show perspective views of a connector comprising a module carrier and a connection module according to the invention, for the stage of crimping in the loading position.
Figure 6B:
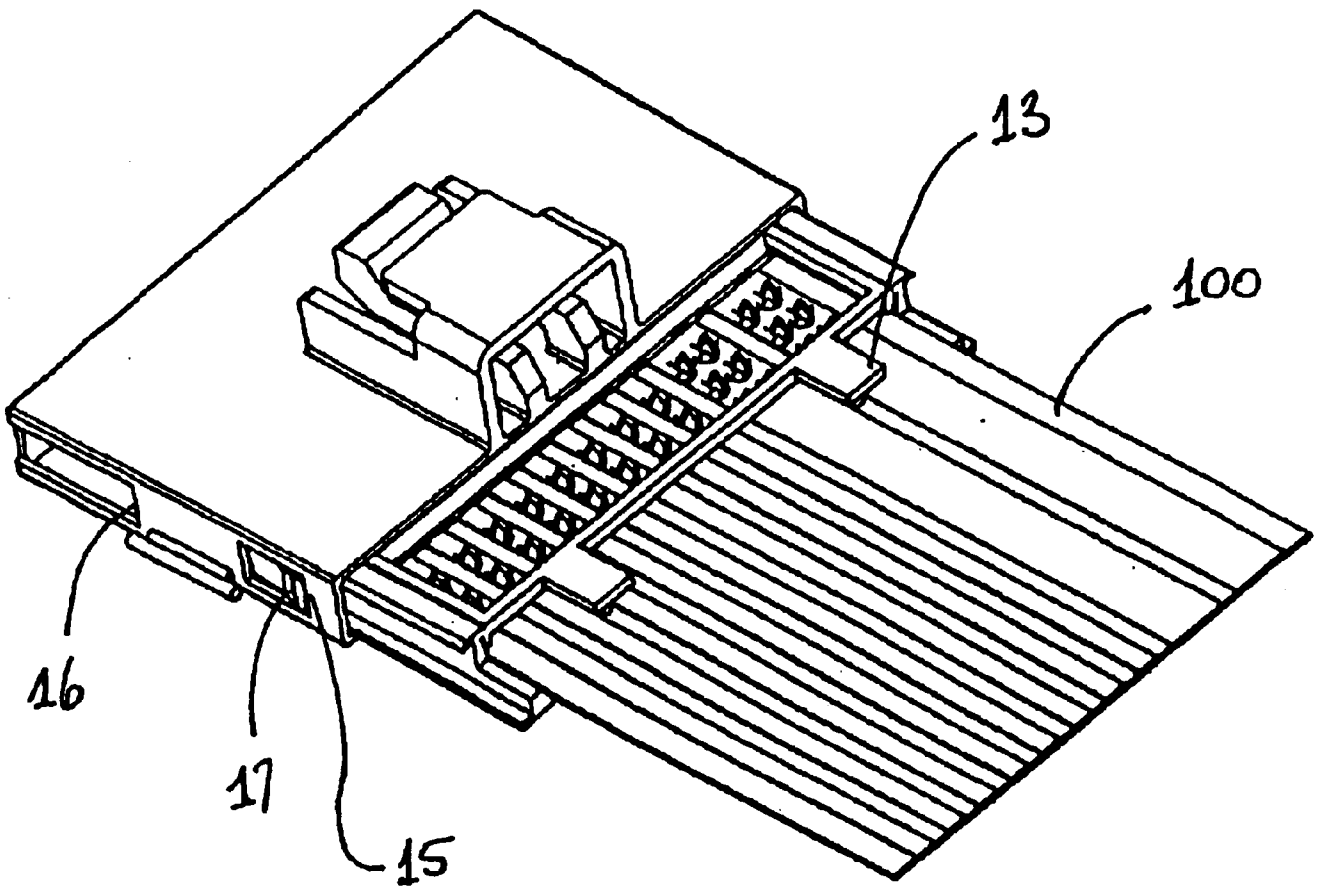

FIGS. 6*a* and 6*b* show the connection casing with an associated module carrier (14). The casing then constitutes a connection module.

The casing and the module carrier can include supplementary latching devices (15, 16, 17), the devices (15) and (17) allowing a partial insertion of the module into a first position called the loading of modules, in which the insertion of the flexible circuit 100 is possible and also allows its crimping. The devices (15) and (16) allow a second locking position called the position of connection of the module(s) into the module carrier, wherein the module carrier is loaded with its modules thus forming a connector which is able to be coupled to a supplementary connector.

Figure 6C:
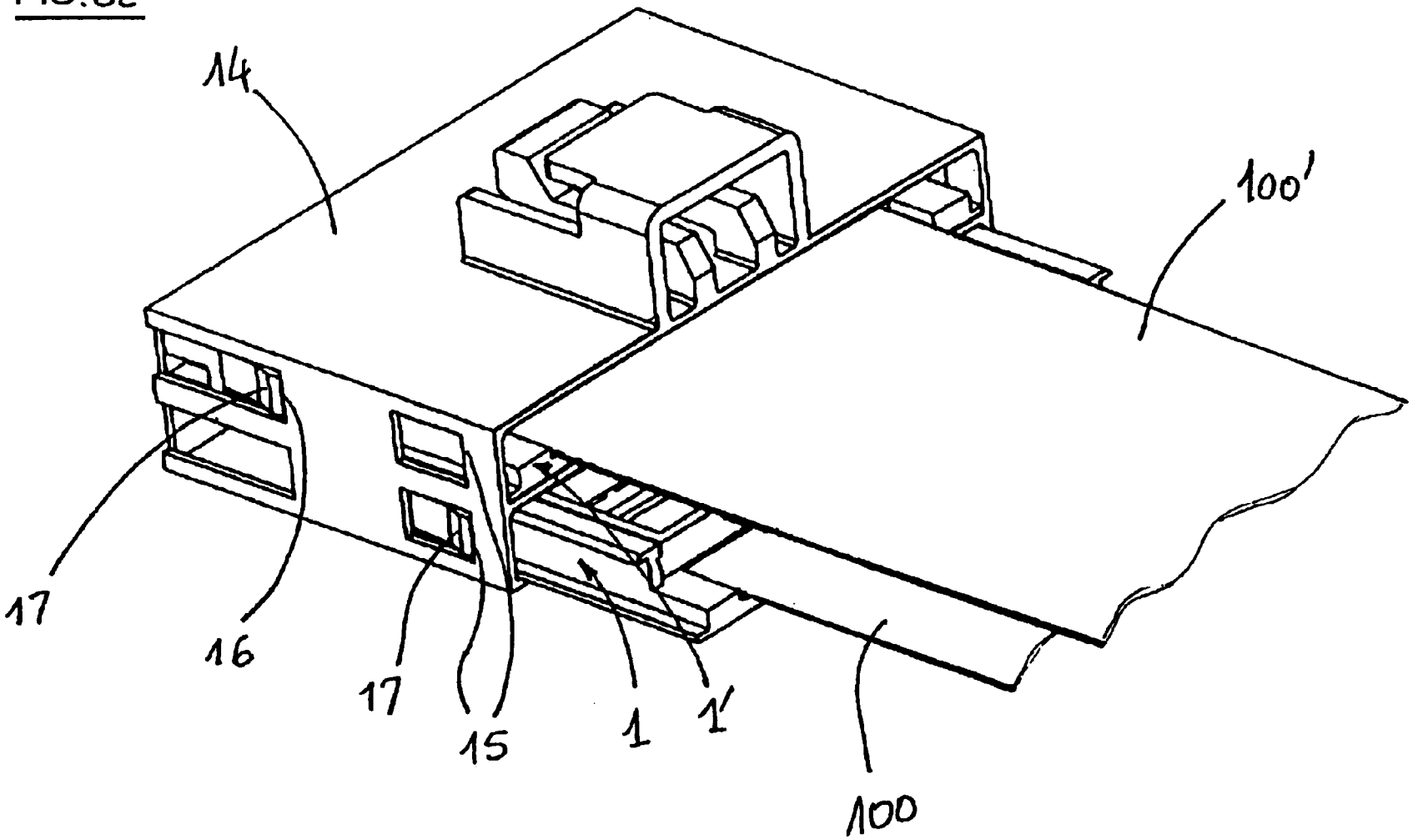
FIG. 6*c* shows a perspective view of a connector comprising a module carrier and several connection modules according to the invention.

FIG. 6*c* shows a module carrier fitted with several modules, the modules in that case being inserted together with their flexible circuit into the module carrier.

According to the invention, the principal steps in the assembly of a connector therefore are:

a—insertion of connectors into plug sockets of the casing;

b—closure of the cover component onto the connectors;

c—sliding of the flexible circuit into a space between the cover forming thee frame and the crimping terminations of the connectors on the flexible circuit;

d—crimping of the flexible circuit on the connectors by means of a tool inserted into the frame.

These steps allow an easy manipulation of the casing loaded with its connectors and an accurate assembly of the flexible circuit to the casing to allow the crimping. It should be noted that the casing can be pre-assembled with its connectors according to stages "a" and "b" and then stored or supplied in that condition, the stages "c" and "d" being performed later.

At these stages and in the case where the flexible circuit is provided with at least one hole, a lug that forms part of the locking frame, inserted into the hole of the flexible circuit and a step of centering and locking of the flexible circuit into the casing is interposed between the step of insertion of the flexible circuit and the step of crimping.

As previously explained, the modules can be supplied with connectors pre-assembled to a cabling station of the flexible circuit or supplied to the said cabling station in their module carrier into the pre-insertion position.

The invention is not restricted to the example described and in particular the cover forming this frame could be a separate part in the same way as the crimping terminations can be of a type other than the ring type.

What is claimed is:

1. A connection device for a flexible circuit comprising: a series of connectors having terminations constructed to engage said flexible circuit by crimping;

a casing fitted with at least one row of longitudinal plug sockets for the reception of said series of connectors, said casing constructed with a cover component which can be manipulated between a pre-insertion position and a locked position, said cover component constructed as a frame defining an opening for admission of a crimping tool component for engaging said crimping terminations with said flexible circuit.

2. A connection device for a flexible circuit, according to claim 1, wherein the casing further comprises a window arranged opposite to said opening in said cover component, between a front portion of the casing which includes the plug sockets and a rear portion of said casing, said window forming an opening for admitting a counter thrust tool.

3. A connection device, according to claim 1, where the frame and the casing are provided with supplementary latching components to lock said cover component in the locked position.

4. A connection device, according to claim 1, wherein the frame is constructed with an opening which provides a space for the introduction of the flexible circuit when said cover component is in the locked position.

5. A connection device, according to claim 1, wherein the frame may be raised with respect to the flexible circuit connection terminations to provide a space for the introduction of the flexible circuit.

6. A connection device, according to claim 1, further comprising a module carrier constructed to receive multiple assembled units of said casing and said series of connectors wherein said units are sequentially stacked to provide loading and crimping of each of said units.

7. A connection device, according to claim 1, wherein the cover component is provided with at least one lug and a seat for the reception and retention of the said lug and further wherein said lug engages said seat through a hole constructed in said flexible circuit.

8. A connection device, according to claim 7, wherein said lug is borne by a folding blade terminal which forms part of the frame.

9. A method of assembling a connection device for a flexible circuit having a series of connectors having terminations constructed to engage said flexible circuit by crimping and a casing fitted with at least one row of longitudinal plug sockets for the reception of said series of connectors, said casing constructed with a cover component (5) which can be manipulated between a pre-insertion position and a locked position, said cover component constructed as a frame defining an opening for admission of a crimping tool for engaging said crimping terminations with said flexible circuit, said method comprising the steps of:

inserting said connectors into the plug sockets;

closing the cover components over the connectors, said connectors being exposed through said opening in said frame;

inserting said flexible circuit between said frame of said cover component and said crimping terminations; and crimping terminations to connect said flexible circuit to said connection device by means of a crimping tool inserted through said opening.

10. The method of assembling, according to claim 9 further comprising the step of:

crimping of said crimping terminations to connect said flexible circuit to said connection device by means of a tool inserted into said opening of the frame and a counter thrust tool inserted into a window constructed in the casing.

11. The method of assembling, according to claim 9, further comprising the steps of:

constructing said flexible circuit with at least one hol; and centering and locking the flexible circuit into the casing by the insertion of a lug constructed as part of the cover component into the hole after said flexible circuit is inserted into the casing.

12. The method of assembling, according to claim 9, further comprising the steps of:

constructing a carrier for receiving multiple units of casings and connectors; and sequentially stacking said multiple units within said carrier in a manner which allows the sequential crimping of said crimping connectors by crimping of said crimping terminations to connect said flexible circuit to said connection device by means of a tool inserted into said opening of the frame and a counter thrust tool inserted into a window constructed in the casing.

* * * * *